US008418269B1

(12) United States Patent
McBride

(10) Patent No.: US 8,418,269 B1
(45) Date of Patent: Apr. 16, 2013

(54) PROTECTIVE HEAD HAVING IMPACT FORCE DISTRIBUTION

(76) Inventor: William B. McBride, Tallahassee, FL (US)

( * ) Notice: Subject to any disclaimer, the term of this patent is extended or adjusted under 35 U.S.C. 154(b) by 359 days.

(21) Appl. No.: 12/806,024

(22) Filed: Aug. 5, 2010

(51) Int. Cl.
*A41B 1/06* (2006.01)
*A63B 71/10* (2006.01)

(52) U.S. Cl.
USPC ..... 2/410; 2/425; 2/414

(58) Field of Classification Search ..... 2/410, 6.6, 2/6.8, 416, 412, 425, 414
See application file for complete search history.

(56) References Cited

U.S. PATENT DOCUMENTS 3,947,832 A * 3/1976 Rosgen et al. ..... 340/539.13
4,024,586 A * 5/1977 Lamb ..... 2/414
4,382,446 A * 5/1983 Truelock et al. ..... 607/110
5,327,585 A * 7/1994 Karlan ..... 2/7
7,314,840 B2 * 1/2008 Baychar ..... 442/370
8,164,170 B2 * 4/2012 Ellis ..... 257/682

* cited by examiner

*Primary Examiner* — Gloria Hale
(74) *Attorney, Agent, or Firm* — Peter Loffler

(57) ABSTRACT

A helmet that protects a user's head from the transfer of force imparted on the outer shell of the helmet. An inner layer of the helmet uses a spacer fabric that diffuses any force received over a relatively large area so that such force is spread over a relatively large area of the user's head, thereby reducing the risk of traumatic brain injury. The helmet uses a thermal pack that helps keep the user either cold or hot as desired. The helmet uses an audio pack that is removably attached to the shell, such that the audio pack protects the hearing of the user from sudden high decibel sounds and also amplifies desirable sound while squelching undesirable noise.

12 Claims, 5 Drawing Sheets

PROTECTIVE HEAD HAVING IMPACT FORCE DISTRIBUTION

BACKGROUND OF THE INVENTION

1. Field of the Invention

The present invention relates to protective head gear, namely a helmet, wherein the helmet distributes a localized impact force across a much larger area relative to area of impact.

2. Background of the Prior Art

The combat helmet is a type of personal protection worn by a soldier during combat. It is one of the oldest forms of personal armor, having been known to be worn by the Assyrians as far back as 900 BC. The modern helmet is typically formed as an outer shell made from a ballistic material such as Kevlar or Aramid. These materials offer excellent bullet and fragmentation stopping power although most helmets are unable to stop a direct hit from a high caliber high velocity round. Although the ballistic outer shell may save the soldier's life, severe injury may occur when a bullet or shrapnel hits the helmet causing the wearer traumatic brain injury. Such traumatic brain injuries may have drastic and long-term negative effects on the sufferer. The reason for such injuries is that ballistic materials are designed to prevent penetration of an incoming round or fragment and not necessarily for energy dissipation. So while the helmet prevents the bullet or fragment from directly contacting and penetrating the user's head, the incoming round or fragment has a tremendous amount of kinetic energy that is absorbed by the outer shell and transferred to the user's head resulting in a localized and often severe injury to the head at the area of impact.

To address this problem, many helmets have an inner layer that is made from a cushioning material such as high density closed cell foam. This cushioning layer is designed to absorb the energy absorbed by the outer shell due to impact from a bullet or fragmentation. This cushioning layer also protects the user from non-ballistic assaults onto the wearer's head such as concussive shockwaves and even vehicle accidents. While such a cushioning layer helps reduce the injury caused from a bullet or fragment impact with the outer shell, the potential for serious injury remains due to the fact that the cushioning layer can dissipate only a certain amount of energy for a given amount of cushioning material. As the helmet must be supported by the neck muscles, the helmet must be relatively light weight so that the soldier can wear the helmet for extended periods of time without undue discomfort. Modern military helmets are designed to be less than four pounds, so the helmet designer must make tradeoffs between the amount of ballistic material to be used versus the amount of cushioning material to be used. Additionally, some weight must be devoted to add brackets that hold various items such as night vision goggles, nape armor to protect the lower head and neck, camouflage coverings, etc. All these requirements make the design of a modern helmet one of tradeoffs and compromises. An additional factor that needs to be considered in helmet design is heat. A helmet traps body heat about the head of the wearer, especially in desert combat situation as has been seen in the last two decades or so. Such heat can dramatically diminish the cognitive functioning of the solder and thus his or her combat effectiveness. As foam tends to be a good heat trap, the helmet designer needs to take this fact into consideration when designing and budgeting for the cushioning layer.

What is needed is a helmet that has ballistic properties so that many bullets and shrapnel fragments are stopped by the helmet yet helps prevent traumatic brain injury as a result of such stoppage and also reduces injury from explosive shock waves such those from nearby explosions. Such a helmet must be able to effectively diffuse the absorbed kinetic energy introduced by the stopped round or fragment allowing the energy to be dissipated over a relatively large area of the user's head. By minimizing the localization of energy absorption by the head, the potential for serious traumatic brain injury at the impact site is significantly lessened. Such a helmet must meet the current requirements for combat helmets by being relatively lightweight and by helping minimize head overheating by the soldier.

SUMMARY OF THE INVENTION

The protective head gear having impact force distribution of the present invention addresses the aforementioned needs in the art by providing a protective helmet that has the typical ballistic stopping powers found in current modern helmets yet helps cushion the kinetic energy absorption that results when a bullet or fragment impacts the outer shell of the helmet. While using a typical cushioning layer, the protective head gear having impact force distribution does not rely in increased use of the foam or similar material that is used for the cushioning layer so that heat retention by the helmet of the present invention is not substantially increased. In fact, the protective head gear having impact force distribution has an active cooling system incorporated within the helmet to help dissipate built up heat. The protective head gear having impact force distribution is relatively lightweight and can be configured in normal fashion.

The protective head gear having impact force distribution of the present invention is comprised of a helmet body that has an outer shell having an outer surface and an inner surface. An inner cushioning structure has a first spacer fabric layer that has a first weave bias direction. The inner cushioning structure attached to the inner surface of the outer shell. The inner cushioning structure also has a foam layer attached to the first spacer fabric such that the first spacer fabric is positioned between the foam layer and the outer shell. A thermal pack (eutectic salt or otherwise) is removably attachable to the inner cushioning structure and held within a cavity therein. A second spacer fabric layer having a second weave bias direction may be provided such that the second spacer layer directly overlays the first fabric layer and such that the first weave bias direction is generally normal with respect to the second weave bias direction. The helmet body has a pair of opposed openings such that an audio pack is removably inserted into at least one of the openings. The audio pack has a microphone, a speaker, and amplification and control circuitry that amplifies a sound received by the microphone and transmits the sound to the speaker. The amplification and control circuitry checks for a decibel level of the sound received by the microphone and if the sound is above a predefined threshold decibel level, the amplification and control circuitry either does not transmit or minimizes the sound transferred to the speaker. The amplification and control circuitry amplifies sounds that fall within a certain frequency range and at least partially squelches sounds that are outside the frequency range. A receiver is electrically connected to the amplification and control circuitry such that the receive is capable of receiving radio waves that are amplified by the amplification and control circuitry and transferred to the speaker. A Faraday Cage of any appropriate design is located within the outer shell and protected therein by the cushioning structures.

BRIEF DESCRIPTION OF THE DRAWINGS

Similar reference numerals refer to similar parts throughout the several views of the drawings.

DESCRIPTION OF THE PREFERRED EMBODIMENT

Figure 1:
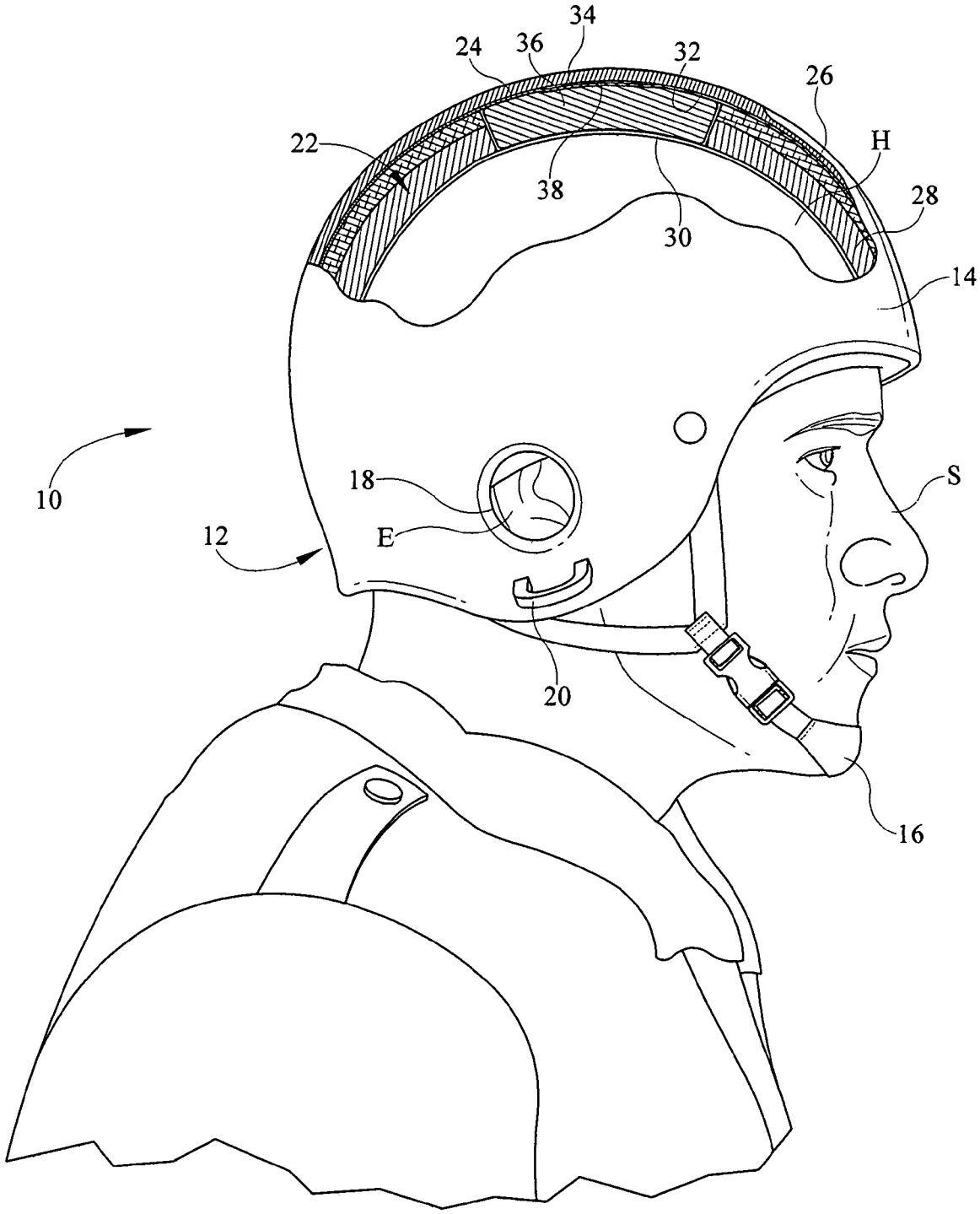
FIG. 1 is a side elevation view, partially sectioned of the protective head gear having impact force distribution of the present invention.
Figure 2:
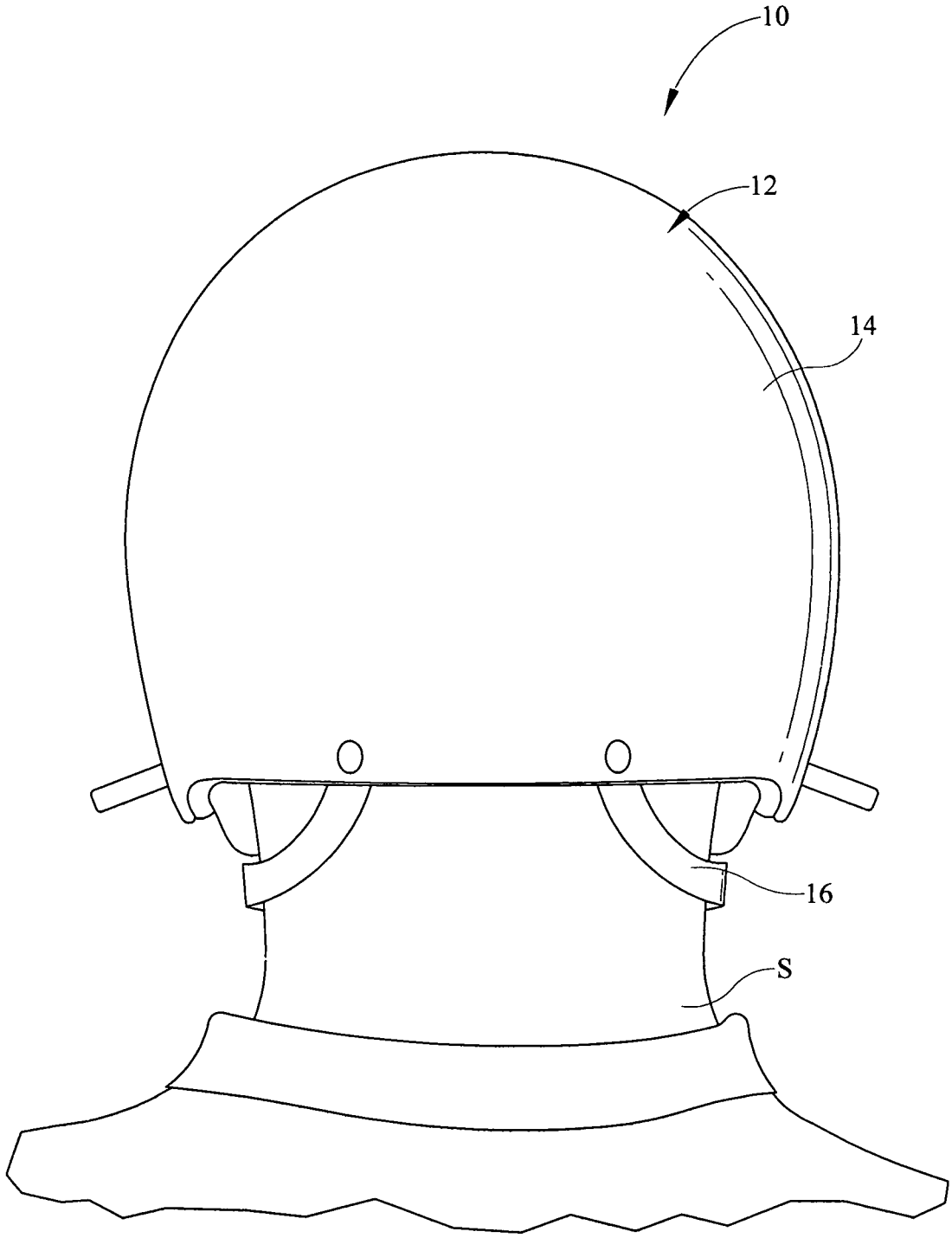
FIG. 2 is a rear elevation view of the protective head gear having impact force distribution.

Referring now to the drawings, it is seen that the protective head gear having impact force distribution of the present invention, generally denoted by reference numeral 10, is comprised of an overall helmet body 12 that has an outer shell 14 that is made from an appropriate ballistic material such as Kevlar, Aramid, Ultra high molecular weight polyethylene (UHMWPE, sold under the trade names Dyneema and Spectra), etc. The shape of the helmet body 12 is based on the needs of the end user. For example, the US Army may desire a relatively high cut back portion of the helmet body 12 in order for the helmet 10 to cooperate with the Army's Improved Outer Tactical Vest currently in use. As seen, appropriate strapping 16 is attached to the helmet body 12 in usual fashion, the specific design of the strapping 16 being end-user defined. As seen, an opening 18 is present on each side of the helmet body 12 which coincides with each ear E of the user S. Appropriate attachment brackets 22 are attached to the outer surface of the helmet body 12.

An inner cushioning structure 22 is located within the interior of the outer shell 14. As seen, the inner cushioning structure 22 comprises a series of layers of various materials including an outer layer of cloth 24 that is attached to the inner surface of the outer shell 14. Below the outer cloth layer 24 is one or more layers of spacer fabric 26, which is a force distribution fabric manufactured by Gehring Textiles, Inc., of Garden City, N.Y.—www.gehringtextiles.com—and referred to as $D^3$ spacer fabric. The spacer fabric 26 spreads out any impact force imparted onto the cloth in all directions, especially in the bias directions of the weave. This distribution of the force allows the force to be absorbed over a much larger area of the head H relative to regular cloth or even foam. If more than 1 layer of spacer fabric 26 is used, then each layer 26 is overlaid onto the previous layer 26 so that the bias directions of the weave do not align. Advantageously, the bias directions of the weave of one spacer fabric layer 26 are generally normal to the bias directions of the weave of the adjoining spacer fabric layer 26. Below the last layer of spacer fabric 26 is a foam layer 28 and below the foam layer 28, is an inner cloth layer 30, the last layer. Attachment of the various layers of the inner cushioning structure 22 is by any method well known in the art such as fabric glue, hot welding (where appropriate), etc.

The inner cushioning structure 22 may be generally uniform throughout, or as seen in FIG. 1, a cavity 32 may be present within a portion inner cushioning structure 22. This cavity 32 is located generally centrally within the overall helmet 10 such that the cavity 32 is positioned generally overtop the top of the head H (the parietal portion of the skull) of the user S whenever the helmet 10 is worn. The cavity 32 is formed by not having the spacer fabric layer 26 and the foam layer 28 present at the cavity 32. Instead, a first portion of cooperating hook and loop material 34 (which includes the newer cooperating hook and pile material) is attached to an inner surface of the outer cloth layer 24. A thermal pack 36, such as a eutectic salt thermal pack has a second portion of hook and loop material 38 thereon. The size and shape of the thermal pack 36 substantially coincides with the size and shape of the cavity 32 so that the thermal pack is removably received within the cavity 32 with the first portion of hook and loop material 34 cooperatively mating with the second portion of hook and loop material 38 in order to removably hold the thermal pack 36 within the helmet 10. An opening (not illustrated) in the inner cloth layer 30 allows the thermal pack 36 to be inserted into and removed from the cavity 32. The inner cloth layer 30 is necessary at the thermal pack 36 site in order to absorb any condensation given off by the thermal pack 36 as well as absorb sweat from the soldier S in the usual way.

Figure 3:
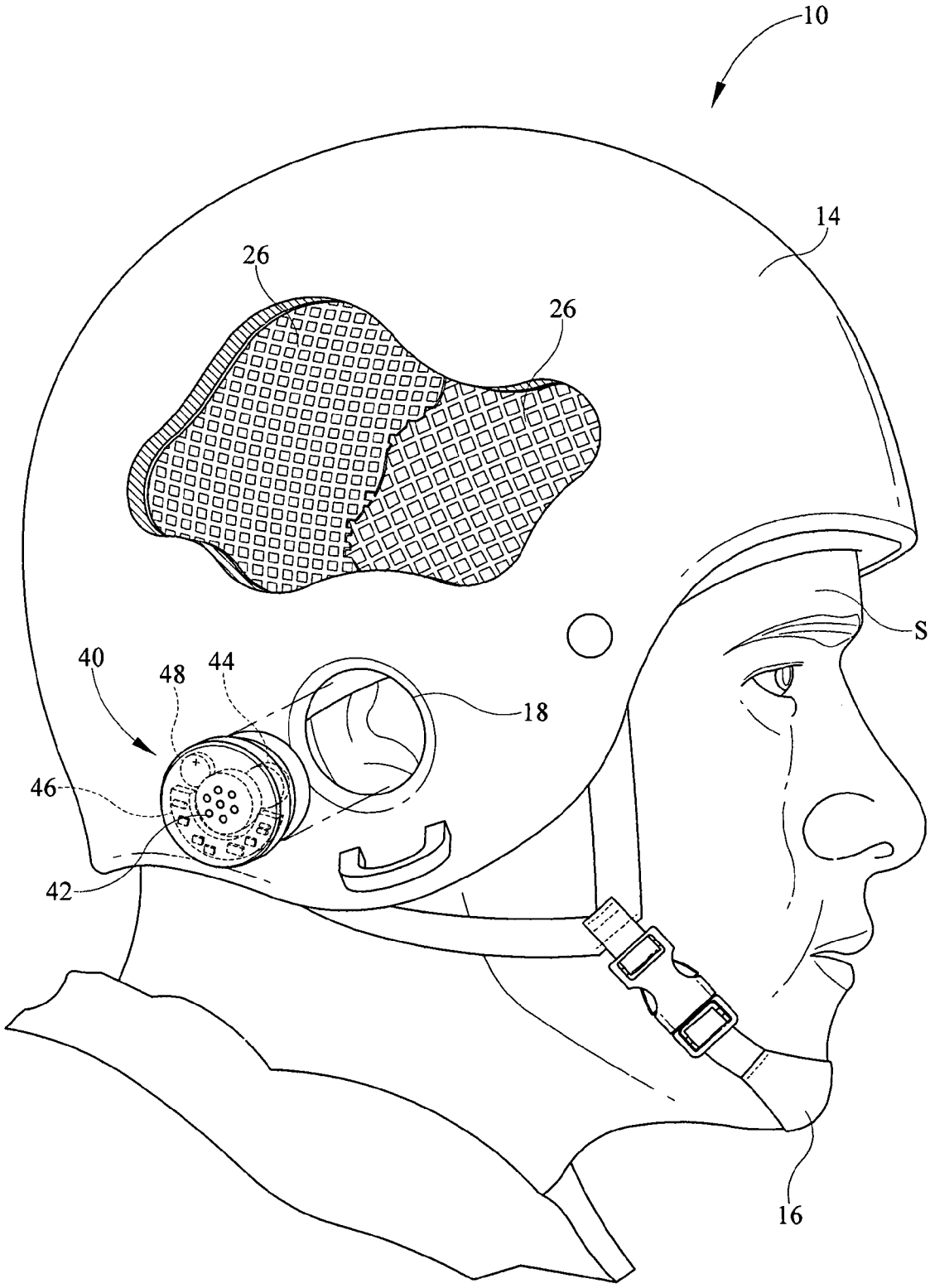
FIG. 3 is a side elevation view, partially cutaway and partially exploded, of the protective head gear having impact force distribution.
Figure 4:
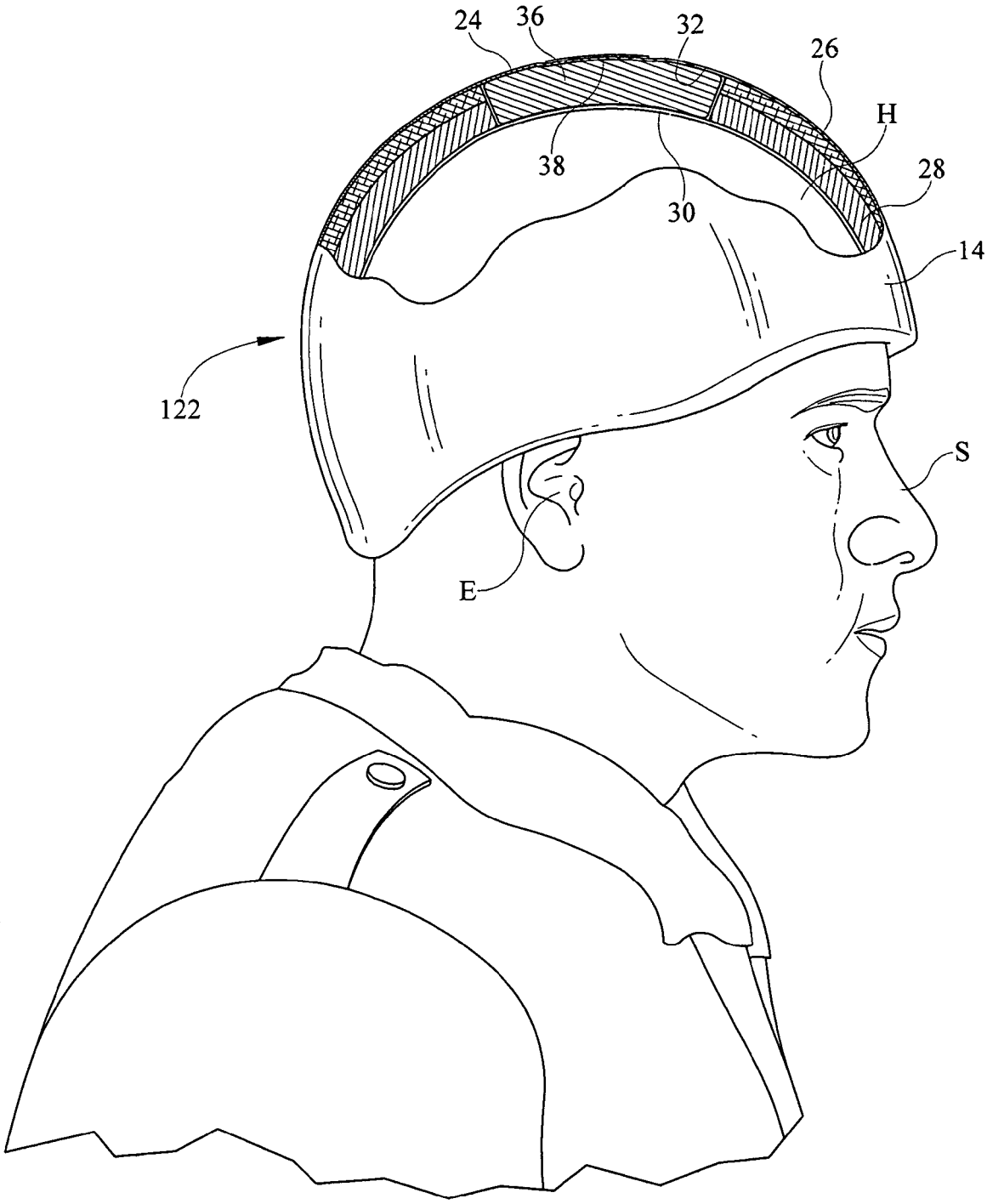
FIG. 4 is a side elevation view, partially sectioned, of the protective head gear having impact force distribution without an audio pack.

As seen in FIG. 3, an audio pack 40 is removably attachable in one or both of the openings 18. Such removable attachment may be in any appropriate fashion such as threaded attachment, press fit attachment, etc. The audio pack 40 contains a microphone 42, a speaker 44, and appropriate amplification circuitry 46 in order to transfer the sound picked up by the microphone 42 to the speaker 44. If only one opening 18 has an audio pack 40, then the other opening 18 has a dummy plug (not illustrated) which offers audio insulation as well as physical protection for the ear area on that side of the helmet 10. If each opening 18 has an active audio pack 40, then the circuitry 46 also provides for synchronization of the two audio packs 40 so that the soldier S hears each desired sound clearly. The circuitry 46 may also have noise canceling circuitry that cancels or minimizes sounds above a certain level, for example about 85 decibels, in order to protect the hearing of the wearer S. Such sound canceling or minimizing circuitry is well known in the art and comes in many forms, such as creating a wave that is exactly 180 degrees out of sync and the same amplitude with the incoming sound wave, etc. Additionally, the circuitry may squelch sounds outside a certain range, for example sounds outside the range of approximately 60-300 Hz—the approximate frequency of most human speech—and amplify sounds within the range in order to allow the wearer S to be better able to hear comrades and possibly even the enemy. Additionally, the audio pack 40 may have a receiver therein that is capable of receiving radio transmissions from a remote site such as a laser spotter receiving messages from an overhead aircraft. The audio pack 40 protects and improves the soldier's hearing on the battle field and also offers some physical protection for the ear area. The audio pack 40 is powered by an appropriate battery 48 that may be rechargeable. Once the soldier S returns to base, the audio pack 40 may be entirely removed and placed into an appropriate recharging unit. If needed, a different audio pack 40 may be reinserted into the opening 18.

Figure 5:
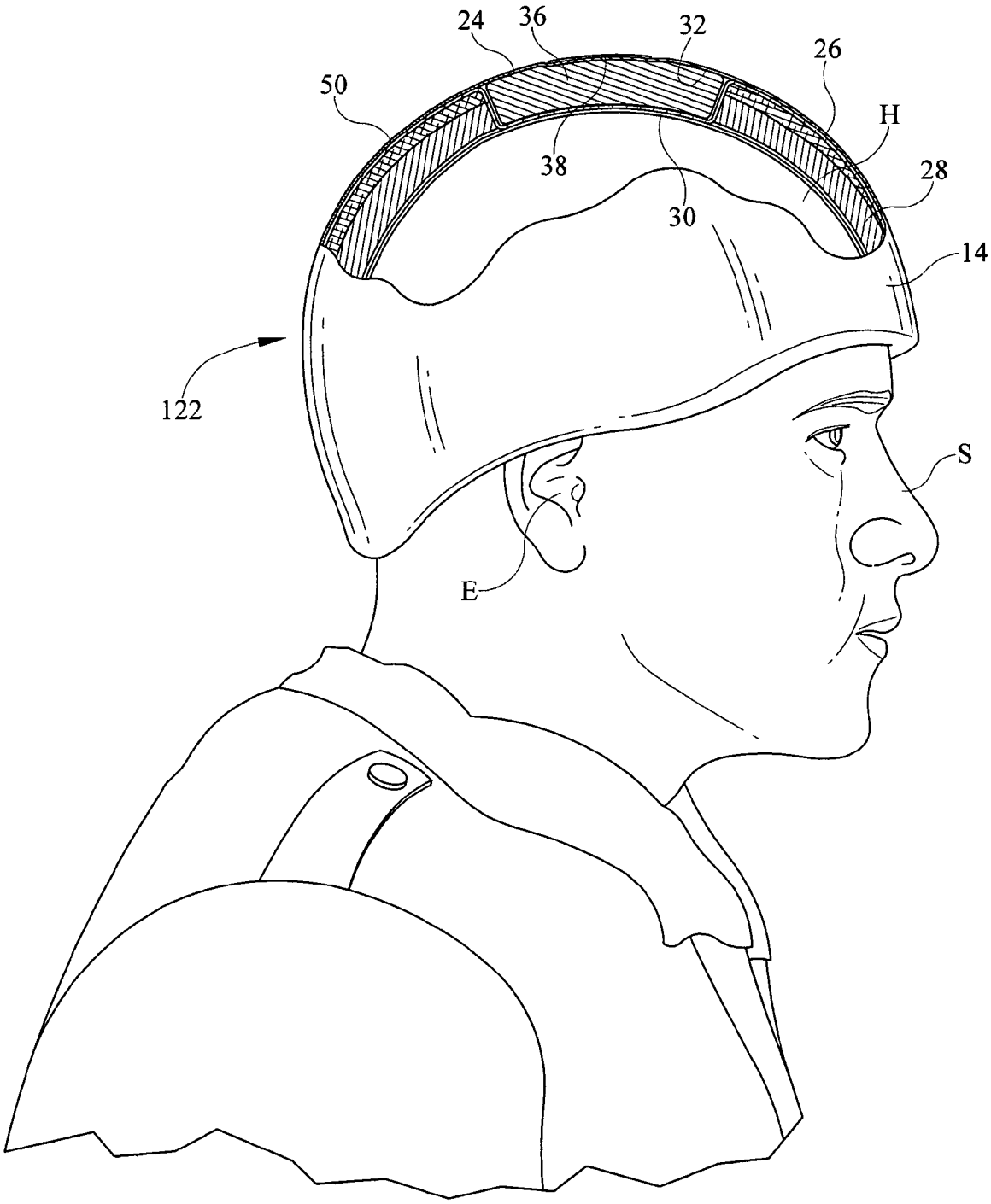
FIG. 5 is a side elevation view, partially sectioned, of the protective head gear having impact force distribution with a Faraday cage.

As best seen in FIG. 5, the inner surface of the outer body 14 of the helmet shell 12 may be lined with an appropriate Faraday Cage in order to protect the wearer from the merging threat posed by electromagnetic pulses. By being against the outer body 14, the relatively delicate Faraday Cage (relatively thin in order to keep the overall device as light as possible), is protected.

In order to use the protective head gear having impact force distribution 10 of the present invention, a thermal pack 36 that has been pre-chilled (or preheated in cold climates) is attached to the helmet 10 within the cavity 32. The helmet body 12 is donned and strapped onto the soldier S in the usual way. At least one audio pack 40 is inserted into one of the openings 18 with another audio pack 40 or a dummy plug inserted into the other opening 18. The soldier S is now ready for duty. The outer shell 14 of the helmet body 14 provides ballistic protection for the head H of the soldier S. If a bullet or fragment impacts the outer shell 14, the force that is transferred down into the inner cushioning structure 22 is spread out over a relatively large area of the user's head via the spacer fabric layers 26. The foam layer 28 offers additional impact protection especially from large blunt force impacts such as those occasioned during vehicle accidents or having an object fall onto the user's head H. The thermal pack 36 helps keep the user's head H cold (or warm as the case may be). By using a eutectic salt type of thermal pack 36, the temperature of the thermal pack 36 remains relatively constant through the useful thermal cycle. The position of the cavity 32 that holds the thermal pack 36 generally centrally within the helmet body 12 positions the thermal pack 36 generally on the top of the head H of the soldier. This allows for the most efficient cooling or heating of the user's head and is the area of the head that is least likely to take a direct highly localized impact so that reliance on the force diffusion provided by the spacer fabric 26 is less likely. The inner cloth layer 30 provides a comfortable fit for the user S as well as providing sweat absorption properties.

The protective head gear having impact force distribution has been described with respect to a combat soldier's helmet, however, the same design may be used for other types of helmets, including police helmets, construction helmets, motorcycle helmets, sports helmets, etc. The particular design of the protective head gear having impact force distribution is tailored for the specific application. For example, a police officer much more likely to come under small arms fire as opposed to heavy rifle fire that a soldier may encounter. Additionally, the officer is apt to be assaulted by blunt objects such as bats, tire irons, or even fists of a perpetrator. Accordingly, the thickness of the outer shell 14 of such a helmet can be reduced due to the reduced firearm and shrapnel threat with the inner cushioning layer 22 thickness increased. Additionally, most officers wear protective helmets only during specialized events such as a SWAT event or a riot, which tend to be very short-term events. Therefore, the use of a thermal pack may be eliminated as the fear of overheating is very small. For other types of helmets, where there is not ballistic intrusion fear, the outer shell 14 may be made from a non-ballistic material in order save the costs of manufacture as well as to allow the use of a material that best protects the wearer from the potential threats being faced. Many sports helmets are generally top of head protectors, such as bike helmets, so that the helmet shell 12 will be cut above the illustrated openings 18 so that audio packs 40 are not used. Also certain sports disallow any type of audio devices within the helmets so that dummy plugs can be used in both openings 18 is the openings 18 are present. In a motorcycle, the audio packs 40 can be tuned so as to amplify sounds made by other vehicles, especially horns, so that the rider is better able to hear the other vehicles on the road While the invention has been particularly shown and described with reference to an embodiment thereof, it will be appreciated by those skilled in the art that various changes in form and detail may be made without departing from the spirit and scope of the invention.

I claim:

1. A helmet worn on a human head, the helmet comprising a helmet body that has an outer shell having an outer surface and an inner surface and an inner cushioning structure having a first spacer fabric layer, the first spacer fabric layer having a first weave bias direction, the inner cushioning structure attached to the inner surface of the outer shell and such that the helmet body has a pair of opposed openings such that an audio pack is removably inserted into at least one of the openings, the audio pack having a microphone, a speaker, and amplification and control circuitry that amplifies a sound received by the microphone and transmits the sound to the speaker.

2. The helmet as in claim 1 wherein the inner cushioning structure has a foam layer attached to the first spacer fabric such that the first spacer fabric is positioned between the foam layer and the outer shell.

3. The helmet as in claim 2 further comprising a thermal pack that is removably attachable to the inner cushioning structure and held within a cavity therein.

4. The helmet as in claim 1 further comprising a thermal pack that is removably attachable to the inner cushioning structure and held within a cavity therein.

5. The helmet as in claim 3 further comprising a second spacer fabric layer having a second weave bias direction such that the second spacer fabric layer directly overlays the first spacer fabric layer and such that the first weave bias direction is generally normal with respect to the second weave bias direction.

6. The helmet as in claim 2 further comprising a second spacer fabric layer having a second weave bias direction such that the second spacer layer directly overlays the first fabric layer and such that the first weave bias direction is generally normal with respect to the second weave bias direction.

7. The helmet as in claim 1 further comprising a second spacer fabric layer having a second weave bias direction such that the second spacer layer directly overlays the first fabric layer and such that the first weave bias direction is generally normal with respect to the second weave bias direction.

8. The helmet as in claim 1 wherein the amplification and control circuitry checks for a decibel level of the sound received by the microphone and if the sound is above a predefined threshold decibel level, either does not transmit or minimizes the sound transferred to the speaker.

9. The helmet as in claim 8 wherein the amplification and control circuitry amplifies sounds that fall within a certain frequency range and at least partially squelches sounds that are outside the frequency range.

10. The helmet as in claim 1 wherein the amplification and control circuitry amplifies sounds that fall within a certain frequency range and at least partially squelches sounds that are outside the frequency range.

11. The helmet as in claim 1 further comprising a receiver electrically connected to the amplification and control circuitry such that the receiver is capable of receiving radio waves that are amplified by the amplification and control circuitry and transferred to the speaker.

12. The helmet as in claim 1 further comprising a Faraday Cage disposed within the outer shell.

* * * * *